United States Patent [19]

Kluge et al.

[11] Patent Number: 4,629,376

[45] Date of Patent: Dec. 16, 1986

[54] ROADWAY FOR DUAL-MODE VEHICLES

[75] Inventors: Bernhard Kluge, Ostfildern; Herbert Mehren; Hans Sack, both of Stuttgart, all of Fed. Rep. of Germany

[73] Assignee: Daimler-Benz Aktiengesellschaft, Stuttgart, Fed. Rep. of Germany

[21] Appl. No.: 661,217

[22] Filed: Oct. 15, 1984

[30] Foreign Application Priority Data

Oct. 13, 1983 [DE] Fed. Rep. of Germany ..... 3337257

[51] Int. Cl.[4] ..... E01B 25/28; E01C 1/02

[52] U.S. Cl. ..... 404/1; 104/247

[58] Field of Search ..... 404/1; 14/1; 104/247; 52/174

[56] References Cited

FOREIGN PATENT DOCUMENTS 2622778 12/1977 Fed. Rep. of Germany ..... 104/247
2652173 5/1978 Fed. Rep. of Germany ..... 104/247
2747675 4/1979 Fed. Rep. of Germany .
3035422 4/1982 Fed. Rep. of Germany .

OTHER PUBLICATIONS

American Association of State Highway Officials (AASHO), "A Policy on Geometric Design of Rural Highways", 1954.

*Primary Examiner*—James A. Leppink
*Assistant Examiner*—John F. Letchford
*Attorney, Agent, or Firm*—Barnes & Thornburg

[57] ABSTRACT

The invention relates to a roadway for dual-mode vehicles with a transition region from non-trackbound to trackbound traffic. On the roadway used as an entering roadway, the transverse guide bar on the driver's side, in the area of the transition region, is extended further into the area of the roadway, which can be used non-trackbound, than the oppositely located transverse guide bar, which is widened slightly funnel-like. The two transverse guide bars of the opposite roadway, which can be used for exiting, end at a mutually equal level. To create an adequately large transverse distance between the roadways in the area where the vehicles filter in, the roadway which can be used as an entering roadway runs with a slight bulge in the area of the transition region; moreover, this provides the possibility of a further adjoining roadway.

12 Claims, 2 Drawing Figures

ROADWAY FOR DUAL-MODE VEHICLES

BACKGROUND AND SUMMARY OF THE INVENTION

The invention relates to a roadway for dual-mode vehicles of the type which includes a transition region from non-trackbound to trackbound traffic. In the area of the trackbound traffic the roadway is provided with transverse guide bars at the two sides. The longer of the guide bars is on the driver's side and extends in the area of the transition region further into the area of the roadway of the non-trackbound traffic than does the other guide bar. Such an arrangement is known, for example, from the German Published Unexamined Patent Application (DOS) No. 2,747,675.

The known arrangement merely shows a transition region from non-trackbound to trackbound traffic for a single direction of travel. The German Published Unexamined Patent Application (DOS) No. 30 35 422 shows a pair of roadways running parallel next to one another for trackbound traffic, in which the transverse guide bars are briefly interrupted for crossing over a crossroad which can be used non-trackbound. The guide bars each end at the same level both at the exiting and entering side and are set up slightly funnel-like relative to one another only in the entry area. The short distance required for crossing the transversely running road is crossed over in a straight line without a track connection in the confidence that no troubling effects will come into play with regard to tne transverse guidance on this short stretch. Tne driver must hold the steering wheel firmly for a short period while traversing the crossroad.

With the double arrangement of two roadways of the type described above used for two-way traffic and with in each case a transition region from non-trackbound to trackbound traffic or vice versa at the same level, certain positioning problems occur with regard to the different width requirements of the roadways with non-trackbound traffic on the one hand and with trackbound traffic on the other hand, to the extent that it must be ensured that buses entering the transition region do not project into the structure clearance of the oncoming roadway during transition to the narrower transverse distance.

The above-mentioned problems of the prior art are overcome by the present invention, which provides for a bulged portion in the trackbound roadway incoming side of a transition roadway section connecting a two-way trackbound roadway with a two-way non-trackbound roadway. Further preferred embodiments of the present invention have the lateral guide tracks disposed differently at the trackbound roadway exit and entrance portions to facilitate the traffic, transition to and from the trackbound roadways. Because of the bulging course of the roadway used as an entering roadway to the trackbound roadway, enough space is provided in the transverse direction with respect to the adjacent oncoming roadway, so that the driver can safely merge in his vehicle without encroacnment from vehicles from the oncoming direction.

In especially preferred embodiments the centerlines of the trackbound roadway leading outwardly, the centerline of the transition roadway, and the centerline of the outbound non-trackbound are aligned with one another. The centerlines for the other roadways are disposed with the non-trackbound roadway centerline spaced further from the centerline of the oppositely directed adjacent non-trackbound roadway than the centerline at the trackbound roadway sections.

Especially preferred embodiments have the trackbound lateral guide bars configured differently for the exiting and the oncoming directions. For the incoming roadway direction the center guide bar is longer than the outside guide bar to accommodate ease of driver merge into the trackbound roadway. For the exit roadway direction the guide bars are of equal length and form a funnel-like connection with the transition section.

According to especially preferred embodiments, the non-trackbound roadway sections are provided with laterally entering and exiting roadways in the region of the transition roadway section leading to and from the trackbound roadways.

Further objects, features, and advantages of the present invention will become more apparent from the following description when taken with the accompanying drawing which shows, for purposes of illustration only, an embodiment constructed in accordance with the present invention.

DESCRIPTION OF THE DRAWINGS

Figure 1:
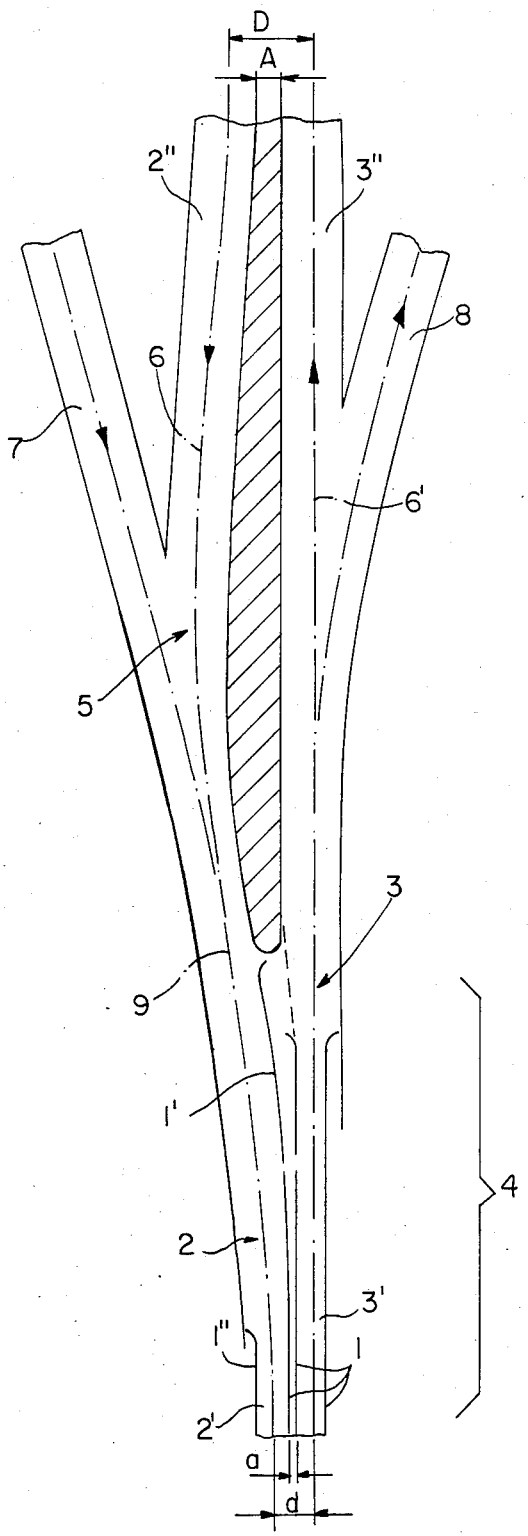
FIG. 1 is a schematic top view of a roadway arrangement constructed in accordance with a preferred embodiment of the invention.

FIG. 1 shows two roadways running next to one another for two-way traffic, the roadways being separated from one another by a center strip. In the top half of the figure, the two roadway sections 2" and 3" can be used non-trackbound; these roadways are not only themselves wider, but the transverse distance D between their center Lines 6 and 6' and also the width A of the center strip are relatively large. The center strip between the roadway sections 2" and 3" which can be used non-trackbound is—as shown—relatively wide only near the transition region. For reasons of a smaller space requirement, the center strip can become narrower and narrower as it moves further away from the transition region, so that finally it only consists of a color-marked separating line. In the bottom half of the figure are shown the two roadways 2' and 3' which can be used trackbound and are bounded on both sides by transverse guide bars 1 which, together with transverse guide rollers on tne vehicle, effect the track connection. Because of the track connection, the width requirement of these roadways and also their mutual transverse distance is substantially less than with the non-trackbound roadways (cf. the smaller transverse distance d between the center lines and the small width a of the center strip). The transition region 4 lies between the trackbound roadway sections 2' and 3' on the one hand and the non-trackbound roadway sections 2" and 3". Roadway 3, shown on the right-hand side of the figure, passes through this transition region in the exiting direction (roadway 3 used as an exiting roadway), whereas the oncoming roadway—roadway 2—is used in the entering direction. The transition from trackbound to non-trackbound traffic is relatively free of problems; the driver must have his hands on the steering wheel in good time before the transition region as is explained in greater detail below.

More difficult is the merging in of the vehicle from non-trackbound traffic (roadway 2″) into the track-guided stretch (roadway 2′). For this purpose, in the area of the transition region 4, the transverse guide bar 1′ on the driver's side is extended further into the area of the roadway 2″ which can be used non-trackbound, whereas the opposite transverse guide bar 1″ has a substantially shorter design and, moreoever, is set up sligntly funnel-like.

The driver must bring the transverse guide roller on the driver's side into lateral contact with the longer transverse guide bar 1′ by means of manual steering, and under contact of this transverse guide roller steer the vehicle further up to the start of the shorter transverse guide bar 1″. Only after the transverse guide rollers have come into contact on both sides at the associated transverse guide bars can tne vehicle be left to itself.

When the transverse guide roller on the driver's side is brought into contact on the one side against the longer transverse guide bar 1′, not only can the vehicle to be merged or filtered in swing over or roll sideways, it can also be positioned too steeply against the longer transverse guide bar, so that it projects relatively far over the transverse guide bar in the direction of the oncoming roadway. This operation of bringing the transverse guide rollers into contact is still carried out—as mentioned—by means of manual steering of the vehicle control lever, and too much lateral approach to the oncoming traffic during this critical operation could not only result in the risk of collision but also of encroachment by oncoming vehicles; the latter could cause the driver to make an instinctive evasive maneuver and lead to trouble in the filtering-in operation. Therefore, to have an adequately large transverse distance with regard to oncoming traffic during the filtering-in operation, the roadway 2 used as an entering roadway is provided with a bulging course 5 in the area of the transition region, with the longer transverse guide bar 1′ extending into the area of the lessening transverse distance between the two roadways. Moreover, in the area of the transition region 4, this bulging of the roadway provides the possibility of a further roadway 7, used as a non-trackbound roadway, running at a tangent into the roadway 2 used as an entering roadway, with the junction point 9 of the two roadways being located at about the level of the start of the longer transverse guide bar 1′.

As it is, since steering maneuvers which have to be followed attentively are required during the filtering-in operation, the transition region can be planned in such a way that the exiting operation at least can be designed as simply as possible; all measures in vehicle handling and in the design of the transition region which make transition difficult are "hurdled" on the one side of the roadway 2 used as an entering roadway. For transition at the roadway 3 used as an exiting roadway, provision is made for simplification for the center line 6′, in the area in front of and behind the transition region 4, to run in a straight line or, in curves, without bend or misalignment smoothly according to the curve course. The limited-width lateral displacement of the center lines is achieved on one side by a corresponding course of the center line 6 of the roadway 2 used as an entering roadway. Since the transverse guide rollers of the two opposite sides of a vehicle are in contact under pretension with the associated transverse guide bars, to avoid steering deflection, even if only slight, that is, to achieve a transverse vibration-free exit from the track-guided area, it is necessary for the two opposite transverse guide bars to end at the same level. Even if—as shown by the dotted line—one of the transverse guide bars can be designed so as to be longer compared with the other one, the part of tnis transverse guide bar at, least—the longer one—relevant for transverse guidance is exactly as long as the opposite transverse guide bar, because the longer part widens funnel-like relative to the center line 6′, and a bend is provided in the longer transverse guide bar at the level of the end of the shorter transverse guide bar. This lengthening acts as an entry aid as with roadway 2 so that in emergencies entry can also be made in the reverse direction into roadway section 3′. Such emergencies could occur during repair work in roadway section 2′ or when a vehicle has broken down in roadway section 3′. In the one case the vehicles normally using roadway 2 have to enter the roadway section 3′ in the wrong direction during the blockage of this roadway; in the other case it may be necessary for a salvage vehicle which can be track-guided to enter from above into the roadway section 3′ up to the damaged vehicle. For normal operation, to obtain additional protection towards the oncoming roadway by means of the transverse guide bar extended on one side, the extension in the illustrative embodiment shown is provided at the transverse guide bar at the center.

A further roadway 8 can also branch off from the roadway 3, used as an exiting roadway, after the trackbound roadway 3′ according to contemplated embodiments of the invention.

Figure 2:
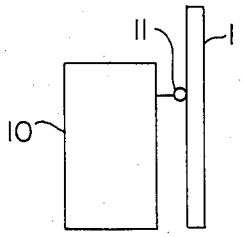
FIG. 2 is a schematic top view of a vehicle with guide rollers utilizing the invention according to FIG. 1.

FIG. 2 schematically shows a vehicle 10 having a guide roller 11 in contact with a guide bar 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Roadway arrangement for dual-mode vehicles comprising:

a trackbound roadway section including a pair of adjacently arranged first and second trackbound roadways configured for two-way traffic in respective opposite directions, a non-trackbound roadway aection including a pair of adjacently arranged first and second non-trackbound roadways, configured for two-way traffic in respective opposite directions, and a transition roadway section includwng a first transition roadway interposed between the first non-trackbound roadway and the first trackbound roadway for carrying traffic in the direction from the first non-trackbound roadway towards the first trackbound roadway, and a second transition roadway interposed between the second non-trackbound roadway and the second trackbound roadway for carrying traffic in the direction from the second trackbound roadway towards the second non-trackbound roadway, wherein said first transition roadway travels a bulging course such that, in the traffic travel direction, the distance between the first and second transition roadways first increases and then decreases as the inlet to the first trackbound roadway is approached, wherein guide track means extends into said first transition roadway, whereby said bulging course provides adequate space in the transverse direction between the first and second transition roadways such that said dual-mode vehicles can merge into said first trackbound roadway from said first non-trackbound roadway, without projecting into the second trackbound roadway.

2. Roadway arrangement according to claim 1, wherein the distance between the first and second non-trackbound roadways is greater than the distance between the first and second trackbound roadway, at least near the transition roadway section.

3. Roadway arrangement according to claim 1, wherein the distance between the first and second non-trackbound roadways is greater in the transition roadway section than in the non-trackbound sections spaced from the transition roadway section.

4. Roadway arrangement according to claim 1, wherein the centerline of the second trackbound roadway extends in a straight line which is aligned with the centerline of the second transition roadway, and wherein the centerline of tne first non-trackbound roadway has a lateral displacement with respect to the centerline of tne second non-trackbound roadway and second transition roadway, both before and after the transition section in the travel direction, which lateral displacement corresponds to the difference in the width of the roadways at the respective sides of the transition roadway section plus the difference in width of the center strips between the roadways of the non-trackbound and trackbound roadway sections.

5. Roadway arrangements according to claim 1, wherein said second trackbound roadway is bounded by a pair of laterally spaced second guide track means, one of said second guide track means located at the side of the first non-trackbound roadway being extended longitudinally relative to the other one of the second guide track means with a funnel-like widening relative to the roadway centerline.

6. Roadway arrangement according to claim 1, wherein said guide track means includes a pair of laterally spaced first guide track means, and wherein said first trackbound roadway is bounded by said pair of laterally spaced first guide track means, and wherein the first guide track means located closest to the second trackbound roadway extends into the decreasing part of the bulging course of the first transition roadway.

7. Roadway arrangement according to claim 6, wherein the second trackbound roadway is bounded by a pair of laterally spaced second guide track means which extend equally to a position forming an exit from the second trackbound roadway to the transition roadway section.

8. Roadway arrangement according to claim 6, wherein the first guide track means located furtherest from the second trackbound roadway is terminated at a spacing in the vehicle travel direction from the other first guide track means.

9. Roadway arrangement according to claim 8, wherein, in the area of the transition roadway section, a further non-trackbound roadway is provided which runs at a tangent into the first non-trackbound roadway used as an entering roadway, with the junction point of the further non-trackbound roadway and the first non-trackbound roadway being located at about the start of the first guide track means located closest to the second trackbound roadway.

10. Roadway according to claim 9, wherein the first guide track means located furtherest from the second trackbound roadway is terminated at a spacing in the vehicle travel direction from the other first guide track means.

11. Roadway arrangement for dual-mode vehicles comprising:

a trackbound roadway section including a pair of adjacently arranged first and second trackbound roadways configured for two-way traffic in respective opposite directions, a non-trackbound roadway section including a pair of adjacently arranged first and second non-trackbound roadways configured for two-way traffic in respective opposite directions, and a transition roadway section including a first transition roadway interposed between the first non-trackbound roadway and the first trackbound roadway for carrying traffic in the direction from the first non-trackbound roadway towards the first trackbound roadway, and a second transition roadway interposed between the second non-trackbound roadway and the second trackbound roadway for carrying traffic in the direction from the second trackbound roadway towards the second non-trackbound roadway, wherein said first transition roadway travels a bulging couse such that, in the traffic travel direction, the distance between the first and second transition roadways first increased and then descreases as the inlet to the first trackbound roadway is approached, whereby said bulging course provides adequate space in the transverse direction between the first and second transition roadways such that said dual-mode vehicles can merge into said first trackbound roadway from said first non-trackbound roadway, without projecting into the second trackbound roadway, wherein said first trackbound roadway is bounded by a pair of laterally spaced first guide track means, and wherein the first guide track means located closest to the second trackbound roadway extends into the decreasing part of the bulging course of the first transition roadway, wherein the first guide track means located furthest from the second trackbound roadway is terminated at a spacing in the vehicle travel direction from the other first guide track means, and wherein the second trackbound roadway is bounded by a pair of laterally spaced second guide track, means which extend equally to a position forming an exit from the second trackbound roadway to the transition roadway section.

12. Roadway arrangement according to claim 11, wherein the centerline of the second trackbound roadway extends in a straight line which is aligned with the centerline of the second transition roadway, and wherein the centerline of the first non-trackbound roadway has a lateral displacement with respect to the centerline of the second non-trackbound and second transition roadway, both before and after the transition section in the travel direction, which lateral displacement corresponds to the difference in the width of the roadway at the respective sides of the transition roadway section plus the difference in width of the center strips between the roadways and the non-trackbound and trackbound roadway sections.

* * * * *